US006857346B1

(12) United States Patent
McLean

(10) Patent No.: US 6,857,346 B1
(45) Date of Patent: Feb. 22, 2005

(54) APPARATUS FOR REMOVING THE TIPS OF TABLET PUNCHES

(75) Inventor: Steven McLean, Brick, NJ (US)

(73) Assignee: Stevens Industries, L.L.C., Pt. Pleasant, NJ (US)

( * ) Notice: Subject to any disclaimer, the term of this patent is extended or adjusted under 35 U.S.C. 154(b) by 19 days.

(21) Appl. No.: 10/122,260

(22) Filed: Apr. 12, 2002

(51) Int. Cl.[7] ..... B26D 1/143
(52) U.S. Cl. ..... 83/169; 83/171; 83/411.1
(58) Field of Search ..... 83/411.1, 733, 83/410.9, 169, 932, 411.2, 411.3, 171; 225/26; 99/643

(56) References Cited

U.S. PATENT DOCUMENTS 1,769,594 A * 7/1930 Nagy ..... 83/717
2,062,739 A * 12/1936 Canaday ..... 83/165
2,256,146 A * 9/1941 Knott ..... 83/409
2,309,396 A * 1/1943 Jackson ..... 225/26
2,621,692 A * 12/1952 Urschel ..... 99/491
2,793,665 A * 5/1957 Pinard ..... 99/643
2,877,816 A * 5/1959 Kibler ..... 43/43.11
3,154,124 A * 10/1964 Cimino ..... 99/491
3,817,423 A * 6/1974 McKnight ..... 198/392
4,478,118 A * 10/1984 Lightner ..... 83/24
5,167,178 A * 12/1992 Cimperman et al. ..... 83/865
5,704,828 A * 1/1998 Young et al. ..... 451/461

* cited by examiner

*Primary Examiner*—Kenneth E. Peterson
(74) *Attorney, Agent, or Firm*—Norman E. Lehrer

(57) ABSTRACT

A machine for removing the tips of tablet punches includes a housing that contains a turret that is rotated about a substantially vertical axis and a cutting wheel. The turret supports a plurality of tablet punches in a substantially vertical position with the tips of the punches being exposed below the turret. A cutting wheel is positioned below the turret and is located in a position so as to be in the path of the tips as the turret rotates. A motor rotates the cutting wheel so that the tips are removed from the punches as they are rotated into the path of the wheel. The turret rotates at a relatively low speed and the cutting wheel rotates at a relatively high speed. A nozzle is directed to the position where the cutting wheel engages the tips of the punches and sprays a cooling fluid in order to cool the cutting wheel and tips to prevent overheating thereof.

9 Claims, 3 Drawing Sheets

APPARATUS FOR REMOVING THE TIPS OF TABLET PUNCHES

BACKGROUND OF THE INVENTION

The present invention is directed toward an apparatus for destroying a tablet punch and more particularly, toward a machine with a cutting wheel that removes the tip of a tablet punch.

Tablets for use as drugs and for other pharmaceutical purposes are typically made by depositing a quantity of the medicinal powder into a die and compressing the powder. This is accomplished by lowering and raising a pair of punches onto the powdered material in the die. The punches are located on turrets that rotate about their respective vertical axis. Some punches have a recessed end portion so that the tablet will have a domed or beveled surface. The recessed portion of one or both of the punches frequently has some type of marking such as a letters, numbers, logos or other indicia thereon which information is transferred onto each tablet. The indicia may provide information concerning the type or dose of the medication or the manufacturer thereof.

The punches discussed above eventually do wear out and must be replaced. Furthermore, they are frequently replaced before they are worn when a particular medication is no longer being produced or when it is desired to change the indicia on the tablets. The Food and Drug Administration in the United States requires that the end portion or tip of each punch be ground or cut off before disposing of the same in order to ensure that the punches will not be improperly reused by others. Undoubtedly, regulatory agencies in other countries have similar requirements.

At present, a grinding wheel is used to grind the ends of each of the punches before they are disposed of. This is done manually by a worker holding the punch and forcing the tip thereof onto the surface of the grinding wheel. However, there are many problems, disadvantages, and safety issues involved in this procedure. Primarily, it is a time-consuming and tedious process as only one punch may be worked on at a time. There is also the possibility that the indicia may not be totally removed and that the punch is then reused. Even further, there is always the danger of injury to the worker who is manually grinding the tips with the grinding wheel.

Therefore, a safe and efficient process for grinding the ends of tablet punches before their disposal is needed.

SUMMARY OF THE INVENTION

The present invention is designed to overcome the deficiencies of the prior art discussed above. It is an object of the present invention to provide a machine for removing the tips of tablet punches.

It is another object of the present invention to provide a safe and efficient process for cutting off the tips of tablet punches before they are disposed of.

In accordance with the illustrative embodiments demonstrating features and advantages of the present invention, there is provided a machine for cutting off the tips of tablet punches. The machine includes a housing that contains a turret that is rotated about a substantially vertical axis and a cutting wheel or disc positioned below the turret. The turret supports or holds a plurality of tablet punches in a substantially vertical position with the tips of the punches being exposed below the turret. The cutting wheel is located in a position so as to be in the path of the tips as the turret rotates.

A motor rotates the cutting wheel so that the tips are removed from the punches as they rotate into the path of the cutting wheel. The turret rotates at a relatively low speed and the cutting wheel rotates at a relatively high speed. A nozzle is directed toward the position where the cutting wheel engages the tips of the punches and sprays a cooling fluid in order to cool the cutting wheel and tips as they are being cut.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
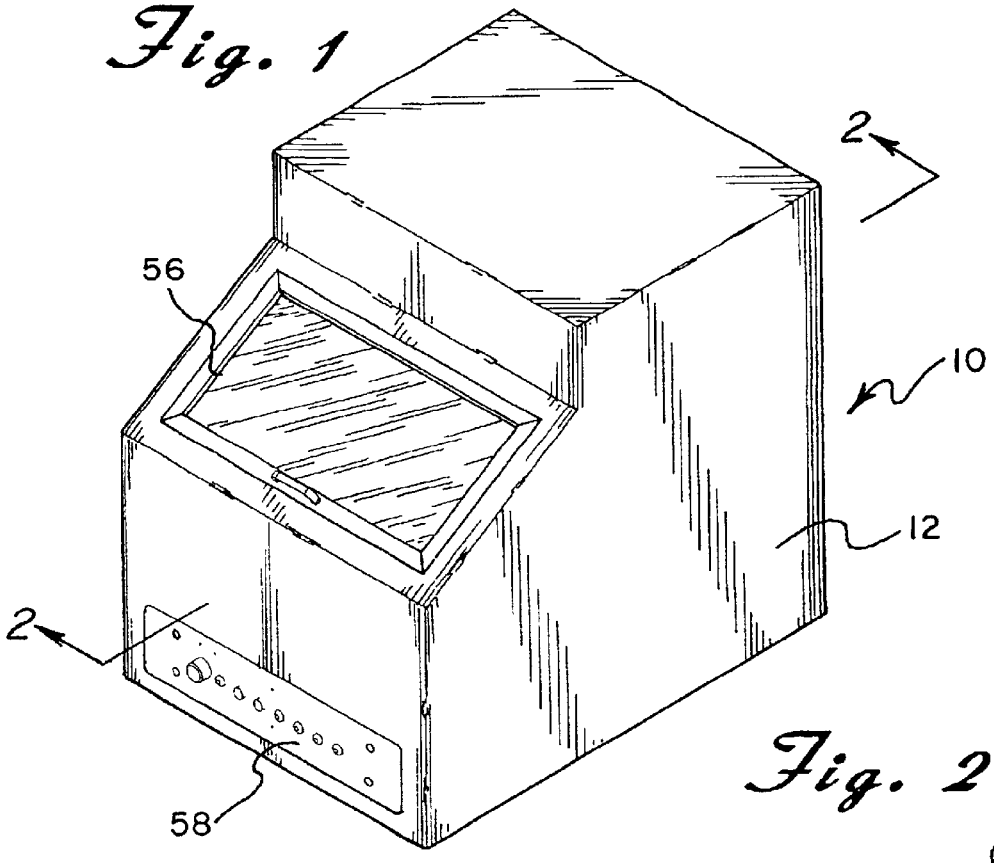
FIG. 1 is a front perspective view of the apparatus of the present invention.

Referring now to the drawings in detail wherein like reference numerals have been used throughout the various figures to designate like elements, there is shown in FIG. 1 an apparatus constructed in accordance with the principles of the present invention and designated generally as 10.

Figure 3:
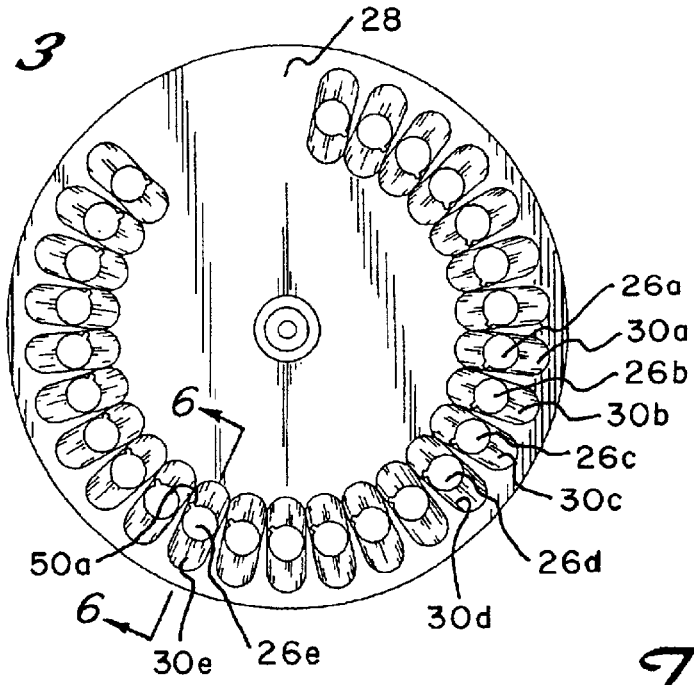
FIG. 3 is a top plan view of the punch holding turret taken along line 3—3 of FIG. 2.
Figure 4:
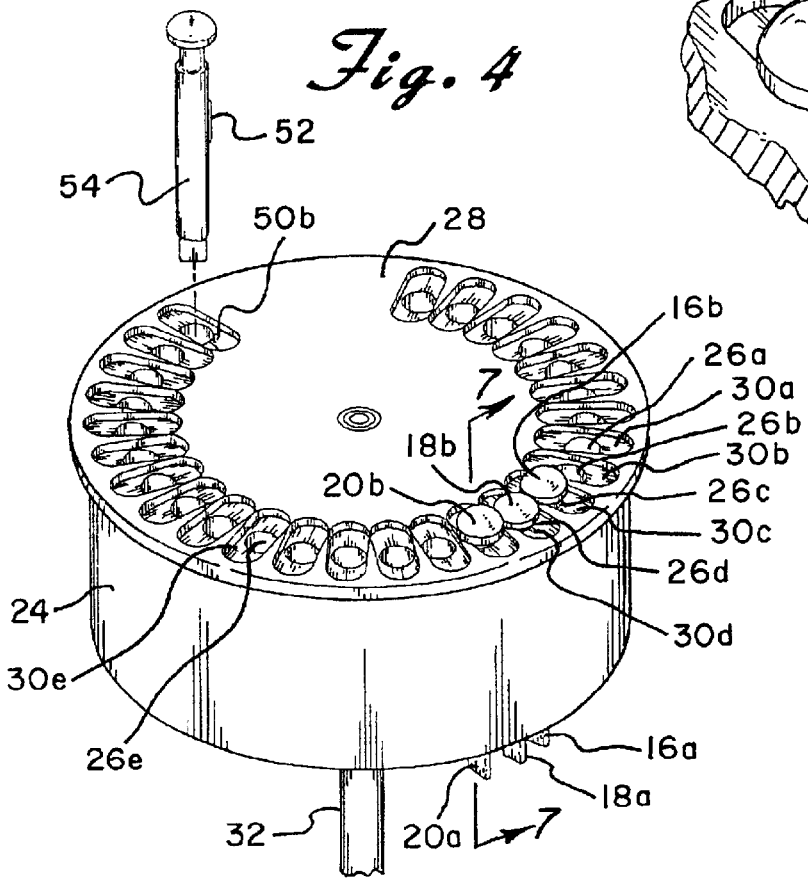
FIG. 4 is an exploded view of a punch being inserted into the turret of the present invention.
Figure 7:
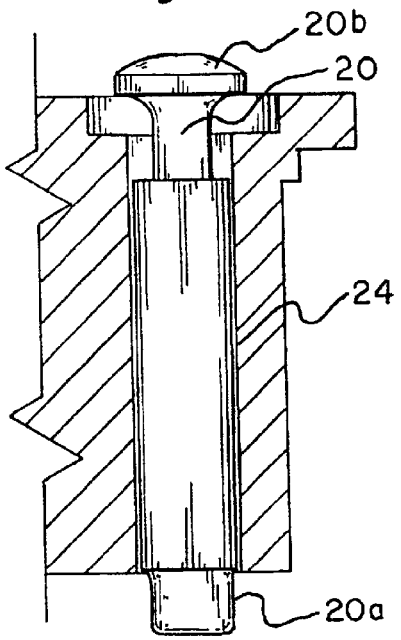
FIG. 7 is a cross-sectional view taken through line 7—7 of FIG. 4.

The apparatus of the present invention essentially includes a housing 12 which contains therein all of the operative devices for performing the required cutting operation. More particularly, mounted within the housing 12 is a means 14 for supporting or holding a plurality of tablet punches 16, 18, and 20 for example, and a cutting wheel or disc 22. The supporting means 14 may be a turret comprised of a drum 24 and a plurality of substantially vertically aligned circular holes, 26*a*–26*e* for example, around the periphery thereof. (See FIG. 3.) The drum 24 may be approximately four inches thick. Each of the holes is adapted to support a punch in a substantially vertical orientation so that the tips 16*a*, 18*a*, and 20*a* of the punches 16, 18, and 20, for example, are exposed below the turret 14. (See FIGS. 4 and 7.) By way of example, there may be twenty-eight such holes in the turret. However, and as should be readily apparent to those skilled in the art, there could be many more or substantially fewer holes thereby requiring a larger or smaller turret to be utilized.

Figure 2:
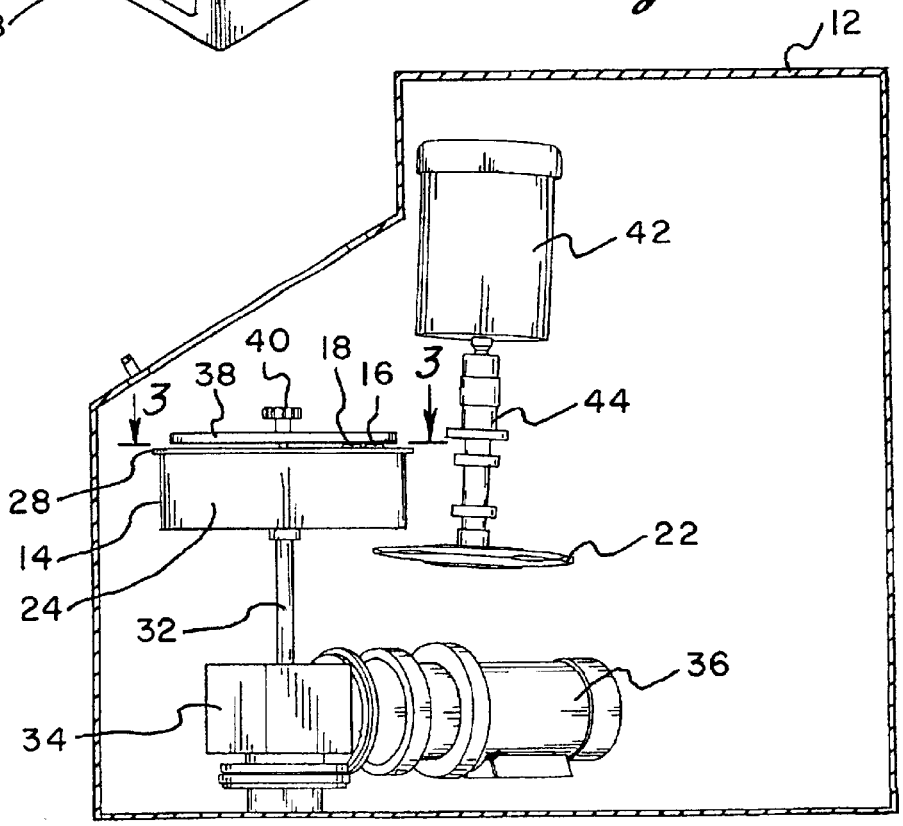
FIG. 2 is a cross-sectional view taken through line 2—2 of FIG. 1 diagramatically illustrating the internal components of the present system.

The turret 14 has an upper plate or surface 28 with a plurality of elongated openings or cutouts, shown for example as 30*a*–30*e*, located therein adjacent each of the circular holes 26*a*–26*e*. Attached to the turret 14 via a drive shaft 32 is a gear box 34 and motor 36. (See FIG. 2.) The motor 36, through the gear box 34, causes the turret 14 to rotate about a substantially vertical axis at a rate of approximately once every forty minutes. Obviously, the speed of the turret could be faster or slower as may be desired. As shown best in FIG. 2, a cover 38 in the form of a circular plate is secured over the openings via screw 40 and holds the punches in place as they are being worked on as will be described in greater detail below.

The cutting wheel 22 is positioned below the turret 14. The wheel 22 is located in a position so as to be in the path of the tips 16*a*, 18*a*, and 20*a* of the punches 16, 18, and 20, respectively, as the punches 16, 18, and 20 are rotated. The wheel 22 has a diameter of approximately 10 inches and has a thickness of approximately ¼ inch. A motor 42 is attached to the wheel 22 via drive shaft 44 and drives the wheel 22 at approximately 3600 rpm. While not specifically shown, the motor 42 is supported by the housing 12 in a manner well known in the art, such as by the use of a bracket or the like.

Figure 8:
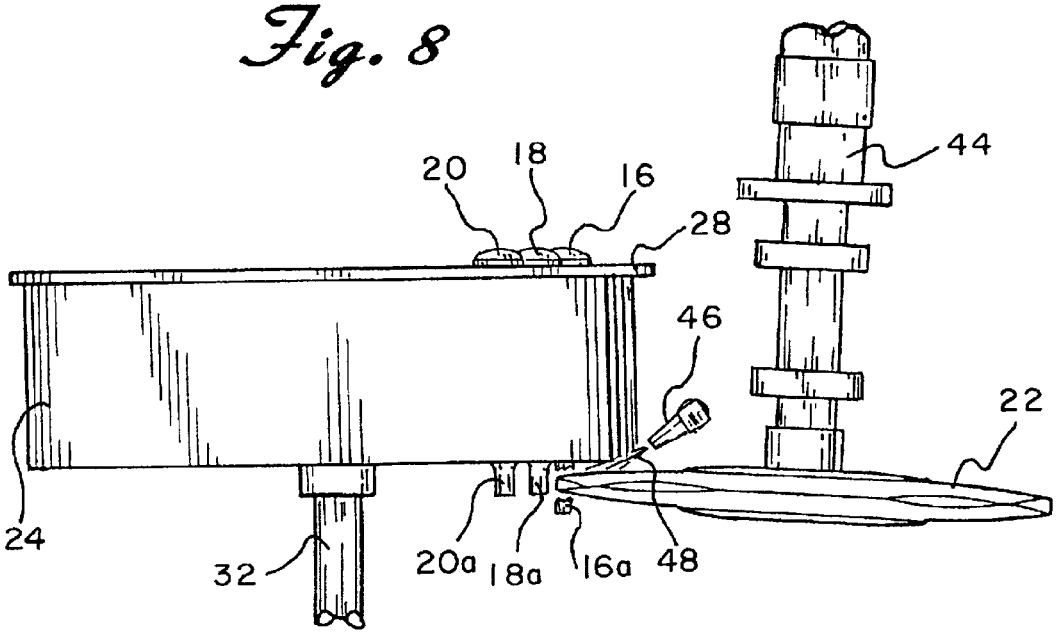
FIG. 8 illustrates the tip of a punch being cut off with the cutting wheel of the present invention.

As best shown in FIG. 8, the wheel 22 is mounted for rotation about an axis which is slightly angled from the vertical. This angle may be approximately three to five degrees. At this angle, the punches that have already been cut will not interfere with the operation of the cutting wheel 22 as they pass over the top thereof after being cut. That is, the cut punches will clear the upper surface of the cutting disc 22 as the turret 14 rotates and will not bind or otherwise engage the upper surface of the cutting wheel 22.

A nozzle 46 for spraying a cooling fluid 48 is also attached to the housing 12 in a manner well known in the art. The spray is directed to the area where the cutting disc 22 engages the tips 16*a*, 18*a*, and 20*a* of the punches 16, 18, and 20, respectively in order to cool the same to prevent overheating. The cooling fluid is preferably a liquid such as water. In the preferred embodiment of the invention, the gear box 34 and motor 36 are covered so that the liquid being sprayed does not cause damage to them. A collection pan may be located at the bottom of the housing in order to collect the spent cooling liquid.

Figure 5:
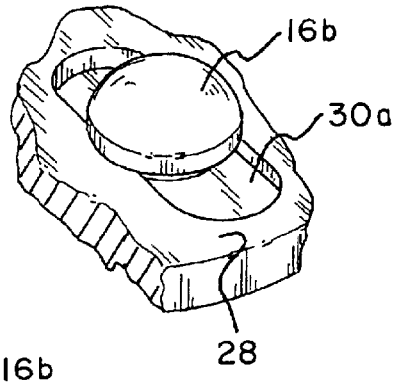
FIG. 5 is an enlarged partial top perspective view of the top of a punch inserted into the turret of the present invention.
Figure 6:
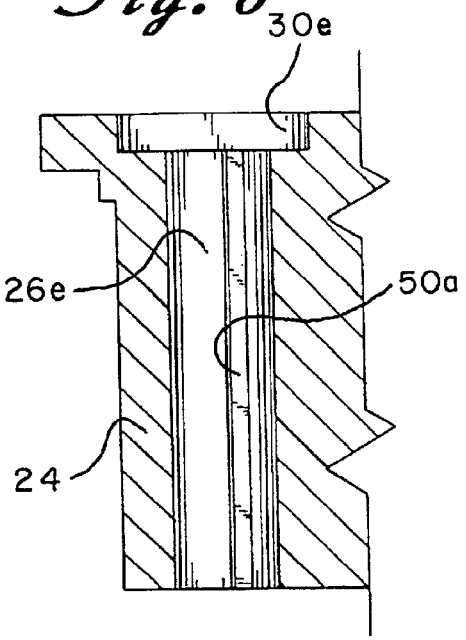
FIG. 6 is a cross-sectional view taken through line 6—6 of FIG. 3.

In order to use the apparatus of the present invention, the glass front door 58 is opened to allow the user access to the interior thereof. The cover 38 is then removed so that the punches may be placed within the holes of the turret 14. Each punch is approximately 5¼ inches long. The tips 16*a*, 18*a*, and 20*a* of the punches 16, 18, and 20, respectively, extend below the turret 14 and the enlarged heads 16*b*, 18*b*, and 20*b* of the punches 16, 18, and 20 extend above the upper plate or surface 28 of the turret 14. Each elongated opening is narrower than the diameter of its respective punch head so that the head rests above the opening. (See FIG. 5.) A key hole 50*a* is located within each circular hole, seen for example at hole 26*e*. (See FIGS. 3 and 6.) Each key hole, for example, 50*b* is aligned with a key 52 on a punch 54. (See FIG. 4.) This prevents the punch from rotating within the circular hole. The cover 38 is then screwed into place on the turret.

The door 56 is then closed and the motor 42 of the cutting disc 22 and the motor 36 of the turret 14 are then turned on using the controls 58 on the front of the housing 12. The disc 22 rotates at a relatively high speed as the turret 14 rotates at a relatively low speed. As the turret 14 rotates, the wheel 22 cuts or removes the tip of each punch. (See FIG. 8.) As discussed above, because the wheel 22 is angled slightly from the vertical, the punches that have been cut do not interfere with the operation of the wheel 22. The nozzle 46 sprays fluid at the area where the tips are being cut to prevent overheating as pointed out above.

Once all of the tips have been cut off, the motors 36 and 42 automatically stop. At this point, the door 56 may be opened. The heads of the punches can then be grasped by a worker one at a time and removed. The elongated openings allow a person's fingers to grasp the head easily for removal.

While the housing 12 is not essential to the working of the device, it does cover the entire device in order to protect workers. That is, the sparks, metal shards and abrasive material that may be produced during cutting are contained within the housing thereby preventing injury to those working in the area of the device. Furthermore, the housing allows the entire device to be self-contained and more easily moveable from one location to another if needed. The glass window in the door 56, however, allows a worker to view the progress of the operation of the apparatus.

The present invention may be embodied in other specific forms without departing from the spirit or essential attributes thereof and accordingly, reference should be made to the appended claims rather than to the foregoing specification as indicating the scope of the invention.

I claim:

1. An apparatus for removing the tips from tablet punches comprising:

means for supporting a plurality of punches for rotational movement about a substantially vertical axis, said supporting means supporting each of said punches in a substantially vertical position with the tips of said punches being exposed below said supporting means;

a cutting wheel positioned below said supporting mans and being located in a position in the path of said tips of said punches as said supporting means rotates so as to be adapted to remove said tips;

means for rotating said supporting means at a relatively low speed;

means for rotating said cutting wheel at a relatively high speed; and a nozzle for spraying a cooling fluid at the position where said cutting wheel engages the tips of the punches in order to cool the same.

2. An apparatus for removing the tips from tablet punches as claimed in claim 1 wherein said angle is from approximately 3 to approximately 5 degrees from the vertical.

3. An apparatus for removing the tips from tablet punches as claimed in claim 1 wherein said cooling fluid is a liquid.

4. An apparatus for removing the tips from tablet punches as claimed in claim 1 wherein said supporting means is in the form of a turret having a plurality of substantially vertically aligned holes around the periphery thereof, each of said holes being adapted to support a punch in a substantially vertical orientation.

5. An apparatus for removing the tips from tablet punches as claimed in claim 4 wherein said turret includes an upper surface and wherein each of said punches includes an enlarged head, said heads extending above the upper surface of said turret when they are supported therein.

6. An apparatus for removing the tips from tablet punches as claimed in claim 5 wherein the upper surface of said turret includes an elongated opening therein adjacent each hole to enable the heads of said punches to be grasped and manually removed.

7. An apparatus for removing the tips from tablet punches comprising:

means for supporting a plurality of punches for rotational movement about a substantially vertical axis, said supporting means supporting each of said punches in a substantially vertical position with the tips of said punches being exposed below said supporting means, said supporting means being in the form of a turret having a plurality of substantially vertically aligned holes around the periphery thereof, each of said holes being adapted to support a punch in a substantially vertical orientation, said turret including an upper surface and wherein each of said punches includes an enlarged head, said heads extending above the upper surface of said turret when they are supported therein, the upper surface of said turret including an elongated opening therein adjacent each hole to enable the heads of said punches to be grasped and manually removed;

a cutting wheel positioned below said supporting means and being located in a position in the path of said tips of said punches as said supporting means rotates so as to be adapted to remove said tips;

means for rotating said supporting means at a relatively low speed; and means for rotating said cutting wheel at a relatively high speed.

8. An apparatus for removing the tips from tablet punches as claimed in claim 7 wherein said cutting wheel is mounted for rotation about an axis which is oblique to said substantially vertical axis of said supporting means.

9. An apparatus for removing the tips from tablet punches as claimed in claim 8 wherein said angle is from approximately 3 to approximately 5 degrees from the vertical.

* * * * *